US005553581A

United States Patent [19]

Hirabayashi et al.

[11] Patent Number: 5,553,581

[45] Date of Patent: Sep. 10, 1996

[54] CONTROL SYSTEM FOR INTERNAL-COMBUSTION ENGINE

[75] Inventors: Kazuo Hirabayashi; Yosuke Tachibana; Norio Suzuki, all of Wako, Japan

[73] Assignee: Honda Giken Kogyo Kabushiki Kaisha, Tokyo, Japan

[21] Appl. No.: 190,925

[22] Filed: Feb. 4, 1994

[30] Foreign Application Priority Data

Feb. 5, 1993 [JP] Japan ..... 5-042035

[51] Int. Cl.[6] ..... F02D 7/00

[52] U.S. Cl. ..... 123/399

[58] Field of Search ..... 123/399, 397

[56] References Cited

U.S. PATENT DOCUMENTS 5,235,951 8/1993 Taguchi et al. ..... 123/399
5,282,450 2/1994 Uchida et al. ..... 123/399
5,320,076 6/1994 Reppich et al. ..... 123/399
5,327,865 7/1994 Riehmann ..... 123/397
5,339,782 8/1994 Golzer et al. ..... 123/399
5,349,932 9/1994 Boverie et al. ..... 123/399
5,366,424 11/1994 Wataya ..... 123/399

*Primary Examiner*—Raymond A. Nelli
*Attorney, Agent, or Firm*—Nikaido Marmelstein Murray & Oram LLP

[57] ABSTRACT

Disclosed is a control device for internal-combustion engine which is capable of detecting an abnormality in accelerator pedal angle sensors throughout a range of accelerator pedal angles and continuing operation even when an abnormality is detected. It includes a first accelerator pedal angle sensor for detecting an accelerator pedal angle, a second accelerator pedal angle sensor for detecting the accelerator pedal angle, and a minor selection device for selecting, as the accelerator pedal angle, a lower value of one of the outputs of the first accelerator pedal angle sensor and the second accelerator pedal angle sensor.

3 Claims, 6 Drawing Sheets

CONTROL SYSTEM FOR INTERNAL-COMBUSTION ENGINE

BACKGROUND OF THE INVENTION

1. Field of the Invention

The present invention relates to a control system for controlling a throttle valve for intake air by detecting the angle of depression of an accelerator pedal (accelerator pedal angle) by a sensor.

2. Description of the Related Art

In a prior-art control system a potentiometer or similar device is used to detect the depression of the accelerator pedal. The potentiometer, however, is likely to produce noise and instantly produces a large change in output if the potentiometer is deteriorated.

There has been in use such an example provided with both a potentiometer and a potentiometer switch for detection of sensor abnormality by comparing their outputs.

This type of prior-art control system, however, is disadvantageous as a motor vehicle will fail in running in the event that the output values of the potentiometer and the potentiometer switch do not agree.

Furthermore it has such a problem that no abnormality can be detected in the whole range of angle of accelerator pedal depression.

SUMMARY OF THE INVENTION

In view of the above-described disadvantages inherent in the heretofore known art, it is an object of the present invention to provide a control system for an internal-combustion engine which is capable of detecting any abnormality of a sensor arising in the whole range of accelerator pedal angles for the purpose of keeping some extent of engine operation in case an abnormality has been detected.

In an attempt to accomplish the object stated above, the control system for an internal-combustion engine having a controller for controlling the amount of intake air or the amount of fuel supplied to the engine, an actuator for driving the controller, a target setting device for setting a target value of the actuator in accordance with an angle of accelerator pedal, and a driving means for controlling the actuator in accordance with a target value set by the target setting device. The control system comprises a first accelerator pedal angle sensor for sensing the angle of accelerator pedal, a second accelerator pedal angle sensor for sensing the angle of the accelerator pedal, and a minor selecting device for selecting a lower value of one of a) the output of the first accelerator pedal angle sensor and the output of the b) second accelerator pedal angle sensor as the angle of the accelerator pedal to be selected.

Since the lower value of one of the outputs of first and second accelerator pedal angle sensors is adopted, it is possible to prevent the effect of noise and also to always keep on operating the internal-combustion engine.

When a difference in outputs between the first and second accelerator pedal angle sensors remains within a permissible range, the control system determines normal operation from the adoption by a NORMAL selection device of the output of the first accelerator pedal angle sensor, thereby enabling the detection of any abnormality through the whole range of accelerator pedal angles.

An upper-limit value is set as a target value by an upper-limit value setting device when a specific length of time has elapsed after the failure of selection of the NORMAL selection device, so that the internal-combustion engine can continue running to some extent in the event that an abnormality has taken place in the accelerator pedal angle sensor.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Hereinafter an exemplary embodiment of a control system for internal-combustion engines according to the present invention will be described with reference to the accompanying drawings.

Figure 1:
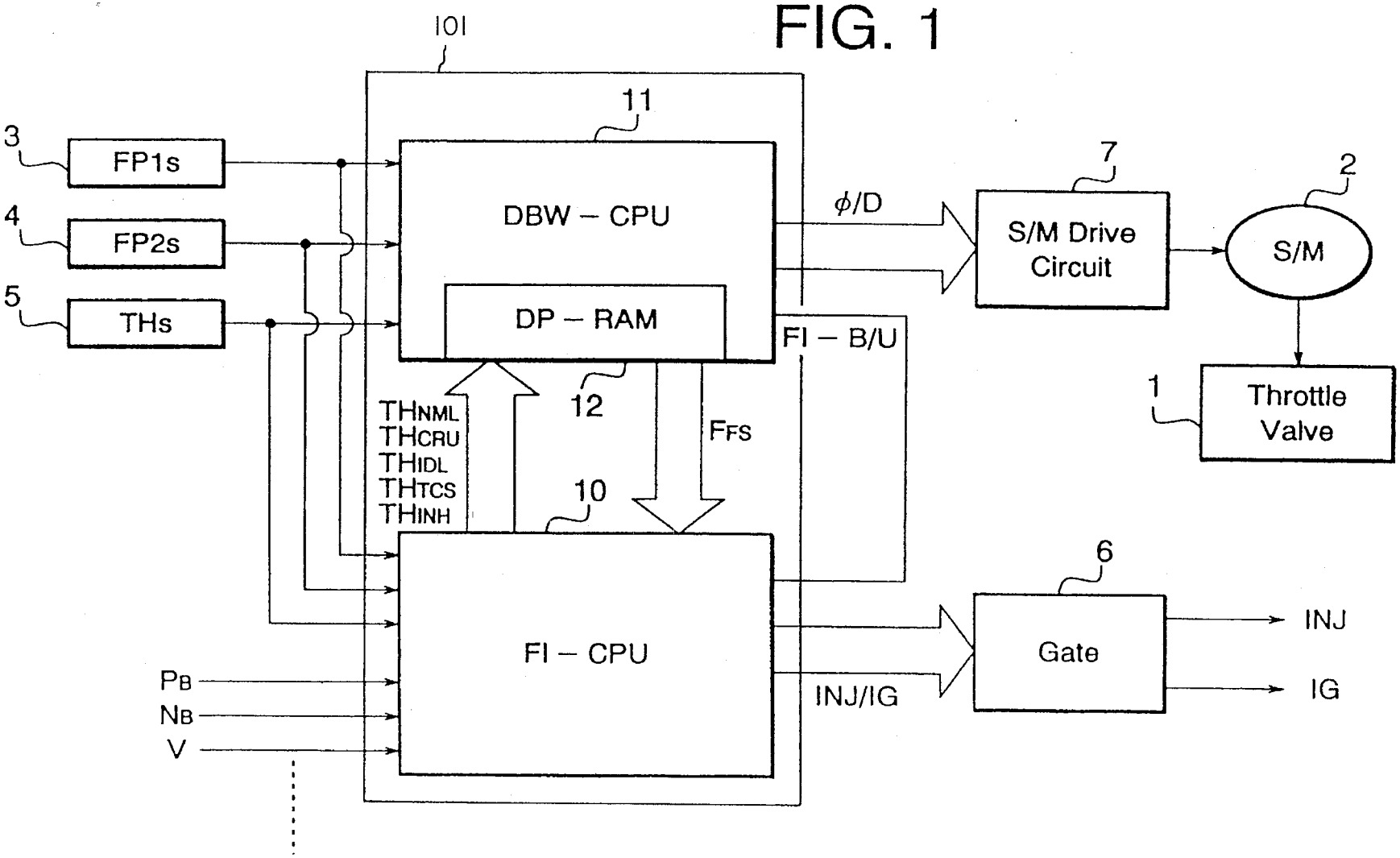
FIG. 1 is a block diagram of one embodiment of a control system according to the present invention.

FIG. 1 is a block diagram of a control system for controlling the amount of a fuel supply in an electronic control unit (ECU) 101 for controlling the operation of the internal-combustion engine and for controlling a throttle valve opening in the intake system.

In the internal-combustion engine of the present embodiment, the amount of fuel being delivered to engine cylinders is controlled by controlling a fuel injection valve, and a throttle valve 1 is driven by a step motor 2 in accordance with the amount of depression of the accelerator pedal.

The angle of depression of the accelerator pedal is detected by the accelerator pedal angle sensor using a potentiometer. There are provided a couple of accelerator pedal angle sensors 3 and 4, which output detection signals $AP1_S$ and $AP2_S$ respectively.

This is because a lower detection value is always adopted for the purpose of protecting the sensor from potentiometer noise resulting from deterioration of the potentiometer.

The amount of opening of the throttle valve 1 is detected and fed back by a throttle valve opening sensor 5.

In the ECU the control of the fuel supply is executed by FI-CPU 10. Fed into this FI-CPU 10 are detection signals from various sensors which detect the operating conditions of the internal-combustion engine; for example, an absolute pressure PB in a intake pipe, engine speed $N_E$, vehicle speed V, accelerator pedal angles $AP1_S$ and $AP2_S$ from the first and second accelerator pedal angle sensors 3 and 4, and the throttle valve opening $TH_S$ from the throttle valve opening sensor 5. An INJ signal for controlling the fuel injection valve according to the engine operating conditions and an IG signal for controlling the ignition timing are output through a gate 6.

In the meantime, the throttle valve opening is controlled by DBW-CPU 11. Into this CPU 11 are input the accelerator pedal angle $AP1_3$ and $AP2_S$ signals from the first and second accelerator pedal angle sensors 3 and 4, a throttle valve opening $TH_S$ signal from the throttle valve opening sensor 5. From this CPU 11 are output excitation phase $\phi$ and duty D signals for driving the step motor 2 to a step motor drive circuit 7, which, in turn, drives the step motor 2.

FI-CPU 10, receiving information from various kinds of sensors, computes common throttle opening $TH_{NML}$ on the basis of the accelerator pedal angles $AP1_S$ and $AP2_S$, a throttle opening $TH_{CRU}$ during automatic cruising on the basis of a vehicle speed V, a throttle opening $TH_{IDL}$ during idling on the basis of the engine speed $N_E$, a throttle opening $TH_{TCS}$ during traction control and a throttle opening $TH_{INH}$ during engine power control on the basis of the vehicle speed V and a driving wheel speed. This information is transmitted to DBW-CPU 11 through DP-RAM 12 which exchanges signals between FI-CPU 10 and DBW-CPU 11.

DBW-CPU 11 determines a final target throttle opening $TH_O$ on the basis of this information, setting and outputting the duty D and excitation phase $\phi$ of the current supplied to the step motor 2 so that the throttle valve 1 may operate at the target throttle opening $TH_O$ under the driving condition of the step motor.

FI-CPU 10 can enter a backup through DBW-CPU 11 depending a upon driving condition or an abnormal condition. At this time, communication by DP-RAM 12 stops.

Figure 2:
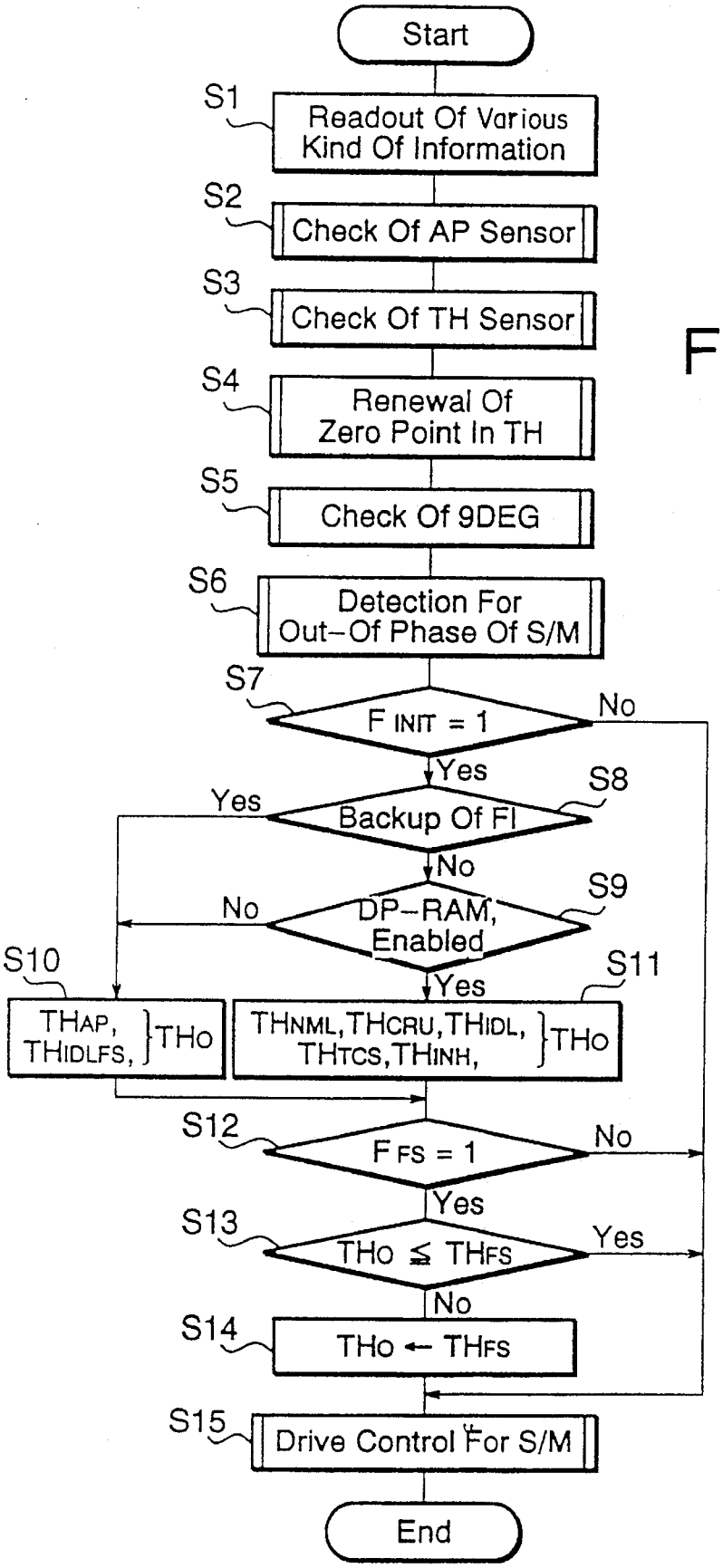
FIG. 2 is a flowchart showing a main routine of DBW-CPU.

A main routine of DBW-CPU 11 in the control system described above will be explained with reference to FIG. 2.

First, signals from various kinds of sensors and information entered from FI-CPU 10 via DP-RAM 12 are read out at Step 1. Then checks are made to see whether there is any abnormality in the accelerator angle sensors 3 and 4 at Step 2 and in the throttle valve opening sensor 5 at Step 3.

Subsequently performed are a check of a fully closed condition of the throttle valve and updating of zero point at Step 4, and further after a check (9DEG check) of throttle valve movement at Step 5, detection is effected for out-of-phase of the step motor 2 at Step 6.

The above-described checks from Step 2 to Step 6 will be described later; in case any abnormality is detected in any one of the checks, "1" will be set at a fail-safe flag $F_{FS}$.

At the next Step 7, whether an initialize flag $F_{INIT}$ is "1" or not is determined; when "1" has not been set up, a specific check has not yet been finished and therefore the procedure will jump to Step 15. Reversely when "1" is present, the procedure will proceed to Step 8, where whether FI-CPU 10 has entered the backup or not is determined. When FI-CPU 10 has entered the backup, the throttle opening $TH_{AP}$ determined by the accelerator pedal angle or the minimum throttle opening $TH_{IDLFS}$ during idling whichever is larger is adopted to easily determine the target throttle opening $TH_0$ at Step 10.

If, at Step 8, FI-CPU 10 has not entered the backup, it is determined whether DP-RAM 12 is usable at Step 9. When it is unusable, the procedure goes to Step 10; when it is usable, the procedure goes to Step 11, thereby determining the final target throttle opening $TH_O$ from various throttle openings $TH_{NML}$, $TH_{CRU}$, $TH_{IDL}$, $TH_{TCS}$ and $TH_{INH}$.

Next, at Step 12, whether or not "1" is set up at the Fuel-safe flag $F_{FS}$ is determined. If "1" is not set up, there exists no abnormality in the throttle control system, and therefore the procedure jumps to Step 15. When "1" is present, there exists an abnormality in the throttle control system, and therefore the procedure jumps to Step 13 where first whether the target throttle opening $TH_O$ exceeds the upper-limit value $TH_{FS}$ is determined. If the upper-limit value $TH_{FS}$ is not exceeded, the target throttle opening $TH_O$, may be usable as it is; if it is exceeded, the upper-limit value $TH_{FS}$ will be used as the target throttle opening $TH_O$ at Step 14.

That is, when there is present any abnormality in the throttle system ($F_{FS}$=1), an upper limit is set of the target throttle opening.

This upper limit value $TH_{FS}$ is a low value, for example a 10° to 15° value.

At Step 15, the step motor 2 is driven and controlled so that the throttle opening will become the target throttle opening THo determined.

The drive control of the step motor will not be described in detail here. The control system adopts the open-loop control of the step motor such that the throttle opening is stored as the current position of the throttle valve opening in a memory which increases or decreases a stored value by one step every time the throttle valve is opened or closed one step, selects either valve opening or valve closing of the current step operation in accordance with a relationship between the current valve position and the amount of the target throttle opening $TH_O$, and at the same time changes the current stored throttle opening by stepping.

In the meantime, on the FI-CPU 10 side, fuel cut-off control is effected; a control routine of the fuel cut control will be explained by referring to FIG. 3.

First, it is determined whether or not an abnormality has occurred in either of the two accelerator pedal angle sensors 3 and 4 at Step 21.

This abnormality information is input from DBW-CPU 11 via DP-RAM 12.

In the event either of No. 1 and No. 2 accelerator pedal angle sensors 3 and 4 has been determined abnormal, the procedure will jump to Step 22, where an upper-limit value $N_{FCAP}$ (for example 1500 rpm) will be entered for a fuel cut-off threshold value $N_{FC}$ of engine speed, and a low speed will be used as the fuel cut-off threshold value.

When it has been determined at Step 21 that there exists no abnormality in at least one of No. 1 and No. 2 accelerator pedal angle sensors 3 and 4, the procedure proceeds to Step 23, where whether or not "1" is set up at the fail-safe flag $F_{FS}$ will be determined. If "1" is not set up, the throttle control system is normally operating. Therefore the procedure will jump to Step 26, where an appropriate value $N_{FCN}$ will be determined on the basis of engine operating condition such as engine water temperature. This value $N_{FCN}$ is used as the fuel cut-off thres-hold value $N_{FC}$ at Step 27.

This fuel cut-off threshold value is set at an overrun preventive speed provided to prevent mechanical breakage of the engine after completion of engine warm-up. This threshold value is so set as to decrease the fuel cut-off speed with the rise of engine temperature for the purpose of preventing engine overheating at Step 27.

When at least one of the first and second accelerator pedal angle sensors 3 and 4 is normally operating and "1" is up at the fail-safe flag $F_{FS}$, there exists some abnormality in the throttle control system. At this time, the procedure will proceed to Step 24, where an engine speed $N_{FCFS}$ predetermined according to the accelerator pedal angle $TH_{AP}$, based on the normal accelerator pedal angle sensor will be retrieved from the drawing shown in FIG. 6. This $N_{FCFS}$ is set as a fuel cut-off threshold value $N_{FC}$ at Step 25.

The fuel cut-off threshold value $N_{FC}$ thus determined is compared with an actual engine speed $N_E$ at Step 28, and when the actual engine speed $N_E$ exceeds the fuel cut-off threshold value $N_{FC}$, the fuel will be shut off at Step 30, cutting the supply of fuel from the fuel injection valve. Reversely when the threshold value $N_{FC}$ is not exceeded, fuel supply will be continued at Step 29.

Therefore, even if there exists any abnormality in the throttle control system ($F_{FC}$=1), fuel supply will be cut off only when the engine speed $N_E$ has exceeded the fuel cut-off threshold value $N_{FC}$ determined in accordance with the normal accelerator pedal angle. When the threshold value $N_{FC}$ has not been exceeded, no fuel cut-off will be effected, permitting the vehicle to keep on running at a low engine speed.

Figure 6:
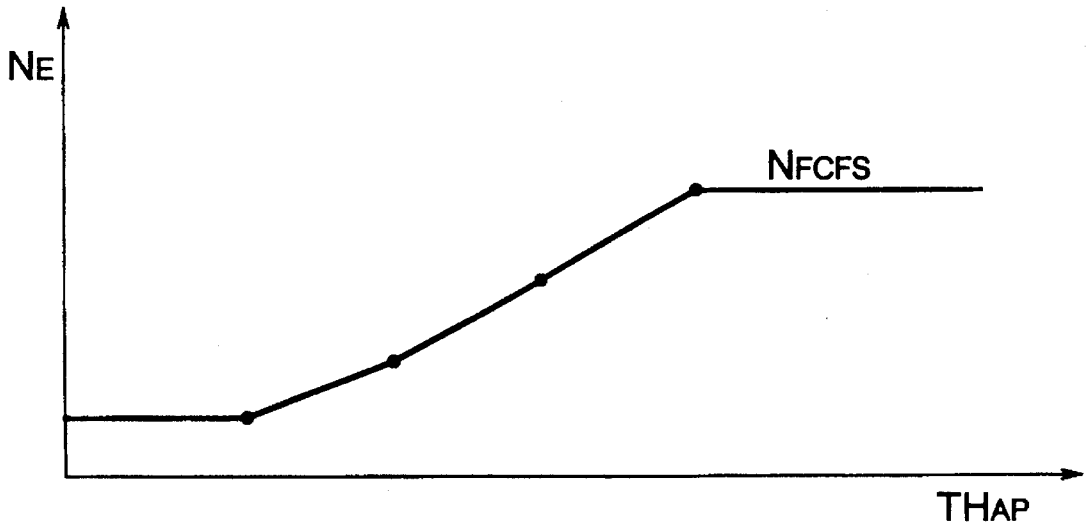
FIG. 6 is a view showing a fuel cut-off threshold value.

FIG. 6 showing a retrieval chart indicates the throttle opening $TH_{AP}$, corresponding to the accelerator pedal angle $TH_{AP}$ on the horizontal axis and the engine speed $N_E$ on the vertical axis. The polygonal line indicates the fuel cut-off threshold value $N_{FCFS}$.

At a small and a large value of $TH_{AP}$, the fuel cut-off threshold value is set at a fixed specific engine speed, and between these two values the fuel cut-off threshold value is set at an engine speed which is generally proportional to $TH_{AP}$.

Therefore the fuel cut-off threshold value thus set is commonly proportional to $TH_{AP}$; when $TH_{AP}$ increases to exceed a certain value, a certain fixed fuel cut-off threshold value will be set.

Fuel supply corresponding to the accelerator pedal angle, therefore, is effected within a range of a certain degree of low engine speeds $N_E$ even if the supply of a great amount of intake air is kept on due to the presence of an abnormality in the throttle control system.

Next, an accelerator pedal sensor check routine at Step 2 of the check steps 2, 3, 4, 5 and 6 for detecting abnormalities in the throttle control system which determines the fail-safe flag $F_{FS}$ will be explained with reference to FIGS. 4 and 5.

Figure 4:
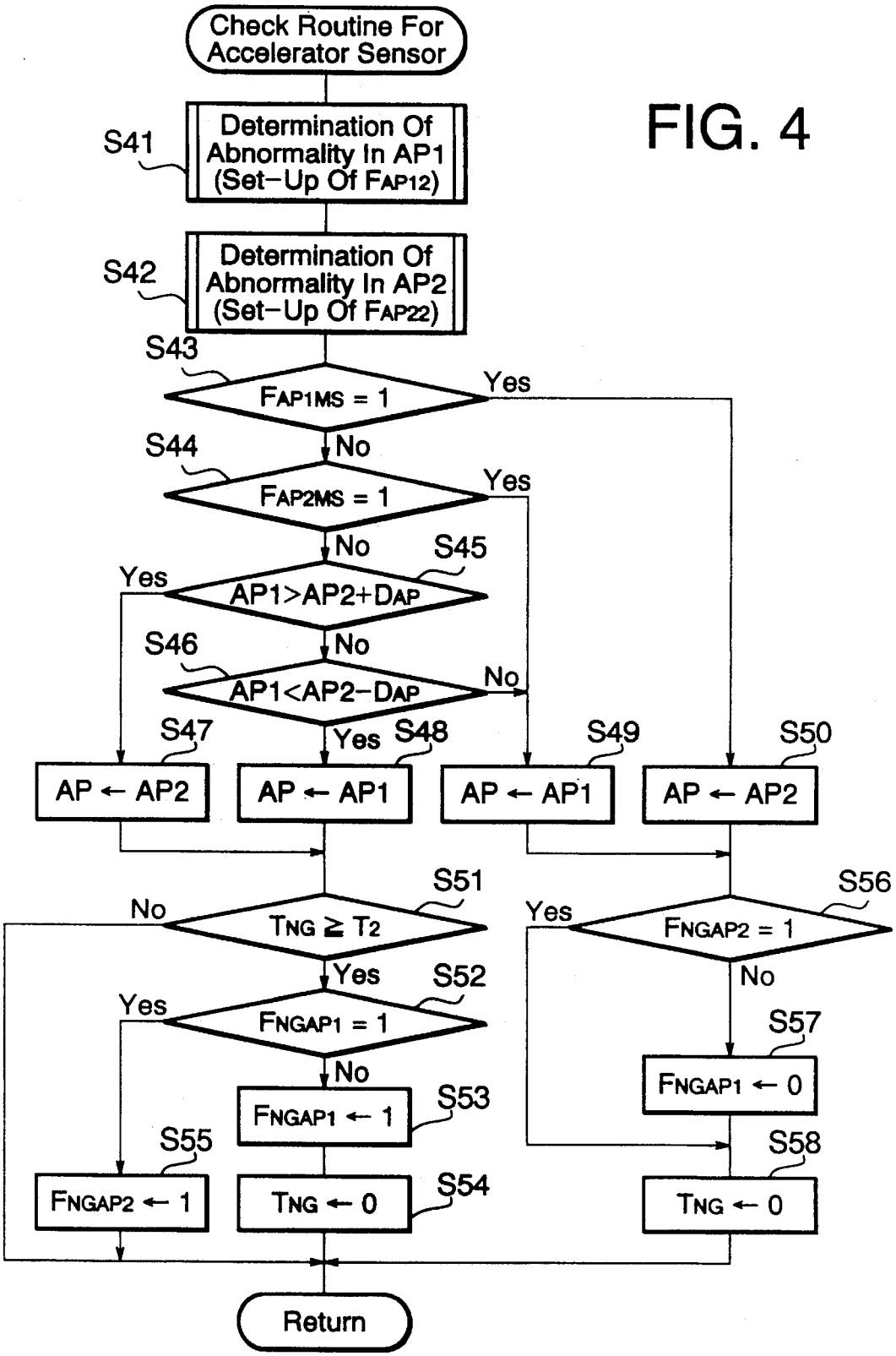
FIG. 4 is a flowchart showing an accelerator pedal sensor check routine.
Figure 5:
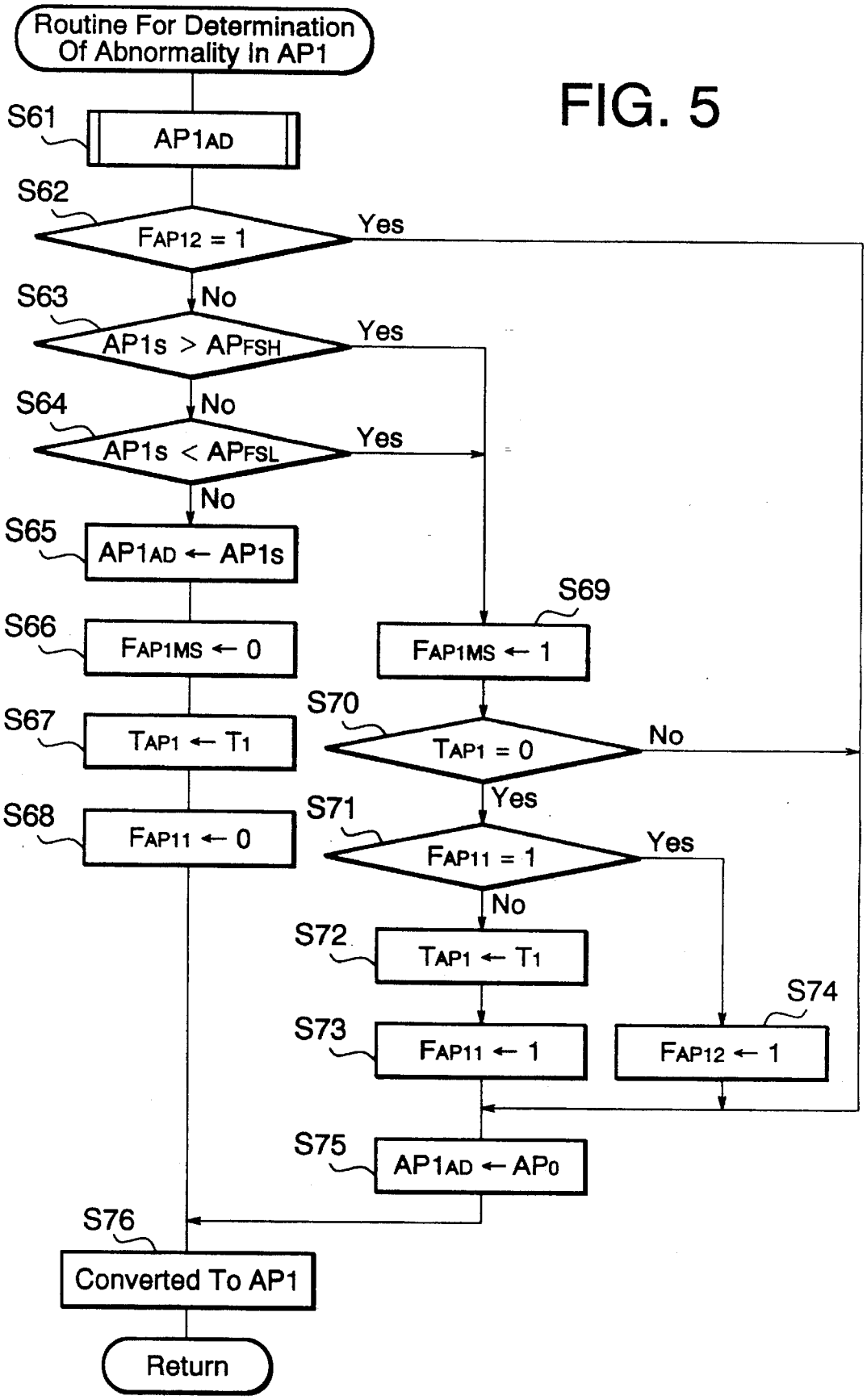
FIG. 5 is a flowchart showing an AP1 abnormality decision routine.

At Steps 41 and 42 in FIG. 4, abnormalities in No. 1 accelerator pedal angle sensors 3 and 4 are decided by the same processing procedure. Accordingly only the abnormality decision routine of No. 1 accelerator pedal angle sensor 3 is shown and hereinafter will be explained by referring to FIG. 5.

At Step 61, the accelerator pedal angle is read out as a digital value $AP1_{AD}$. At Step 61 whether or not "1" is set up at No. 1 accelerator pedal angle sensor abnormality (AP1 abnormality) flag $F_{AP12}$ is determined. Since "1" is not set up at first, the procedure will proceed to Step 63, where it will be determined whether or not the upper-limit value $AP_{FSH}$ is exceeded by the detected value $AP1_S$ of the first accelerator pedal angle sensor 3. If the upper-limit value is exceeded, there will be a problem of a disconnection and a short circuit; the procedure, therefore, jumps to Step 69. When the upper-limit value is not exceeded, the procedure proceeds to Step 64, where it is determined whether or not the detected value AP1S of the first accelerator pedal angle sensor 3 is below the lower-limit value $AP_{FSL}$. If the detected value is below the lower-limit value, there is a problem of a short circuit. In this case, the procedure jumps to Step 69. When the detected value is not below the lower-limit value, there is no problem of a disconnection and a short circuit; therefore the procedure proceeds to Step 65.

At Step 65, a normal detected value $AP1_S$ of the first accelerator pedal angle sensor 3 is set at the accelerator pedal angle $AP1_{AD}$, an abnormality temporary flag $F_{AP1MS}$ is set at "0" at Step 6; T1 is set to the timer $T_{AP1}$ at Step 67; and a first AP1 abnormality flag $F_{AP11}$ is set at "0". At next Step 76, $AP1_{AD}$ is converted to first accelerator pedal angle AP1 based on the accelerator pedal angle during idling.

In the meantime, if there is a problem of a disconnection or a short circuit at Steps 63 and 64, the procedure will jump to Step 69, where "1" will be set at the AP1 abnormality temporary flag $F_{AP1MS}$; and at Step 70 it is determined whether or not the timer $T_{AP1}$ has completed its assigned time. Until the completion of the assigned time, the procedure jumps to 75; after the completion of the assigned time, it is determined whether or not "1" is set at the first AP1 abnormality flag $F_{AP11}$, at Step 71. Since "1" is not set at first, the procedure will proceed to Step 72, where the timer $T_{AP1}$ is reset to $T_1$ to set up "1" at the first AP1 abnormality flag $F_{AP11}$ at Step 73.

At Step 75, a specific angle AP0 close to a full-close angle is to be entered as the accelerator pedal angle $AP1_{AD}$.

If a disconnection or a short circuit still continues, procedures at Steps 63 or 64, 69, 70 and 75 are repeated, and when the timer $T_{AP1}$ has completed its assigned time, the procedure jumps from Step 70 to Step 71. As "1" is already set up at the first AP1 abnormality flag $F_{AP11}$, the procedure jumps to Step 74, where "1" is set up at the second AP1 abnormal flag $F_{AP12}$.

The second AP1 abnormality flag $F_{AP12}$ finally becomes a flag indicating an abnormality of the first accelerator pedal angle sensor.

Under a temporary abnormal condition and under a defined abnormal condition, the accelerator pedal angle $AP1_{AD}$ is set to a small angle $AP_O$, at Step 75, subsequently is converted to AP1 at Step 76.

The AP1 abnormality decision routine has heretofore been described; the decision of AP2 abnormality is executed of the second accelerator pedal angle sensor 4 by the similar procedure Step 42 in FIG. 4, where the accelerator pedal angle AP2 is determined. When the sensor 4 is in the temporarily abnormal condition, "1" is set up at the AP2 abnormality temporary flag $F_{AP2MS}$, and upon the decision of abnormality, "1" is set up at the AP2 abnormality flag $F_{AP22}$.

After the decision of abnormalities in first and second accelerator pedal angle sensors 3 and 4 as described above, the procedure proceeds to Step 43 in FIG. 4, where whether or not "1" is determined at the AP1 abnormality temporary flag $F_{AP1MS}$. When "1" is determined, there is an abnormality in No. 1 accelerator pedal angle sensor 3, accordingly the procedure jumps to Step 50, where the angle AP2 based on the second accelerator pedal angle sensor is adopted as the accelerator pedal angle AP for subsequent control.

When there is an abnormality also in the second accelerator pedal angle sensor 4, and since the angle $AP_O$ close to the angle of a full-close valve opening has already been entered for the angle AP2, the adoption of AP2 at Step 50 will set a specific angle $AP_O$, close to the angle of full-close valve opening for the accelerator pedal angle AP finally selected.

Furthermore, when there is no abnormality in the first accelerator pedal angle sensor 3 but the second accelerator pedal angle sensor 4 has abnormality, the procedure proceeds from Step 43 over to Step 49 through Step 44. At Step 49 the angle AP1 based on the first accelerator pedal angle sensor 3 having no abnormality is set as the accelerator pedal angle AP.

When at least one of No. 1 accelerator pedal angle sensor 3 and second accelerator pedal angle sensor 4 has an abnormality, the procedure proceeds from Step 49 or Step 50 to Step 56.

On the other hand, if the accelerator pedal angle sensors 3 and 4 have no abnormality of disconnection and short circuit, the procedure proceeds to Step 45, where a decision is made of whether or not AP1 is greater than AP2 by a difference exceeding the permissible value $D_{AP}$. If AP1 is greater than AP2, the procedure proceeds to Step 47, where AP2 of the smaller value is selected for the accelerator pedal angle AP; reversely if AP1 is not greater than AP2, the procedure proceeds to Step 46, where a decision is made of whether or not AP1 is less than AP2 by a difference exceeding the permissible value DAP. If AP1 is less than AP2, the procedure proceeds to Step 48, at which AP1 of the smaller value is selected as the accelerator pedal angle AP. If, in this case, AP1 does not make a great difference, the procedure proceeds to Step 49 to select AP1 for the accelerator pedal angle AP.

It is possible to easily determine the normal condition throughout the range of the accelerator pedal angle.

That is, when a difference between AP1 and AP2 exceeds the permissible value $D_{AP}$, there exists a relative abnormality; an accelerator pedal angle of a smaller value will be selected as the accelerator pedal angle AP, and the procedure proceeds to Step 51.

Since the smaller one of the outputs of the two accelerator pedal angle sensors 3 and 4 is selected, the sensors will not be affected by noise.

Furthermore when the difference between AP1 and AP2 is less than $D_{AP}$, there is no difference in the detected values between first and second accelerator pedal angle sensors 3 and 4 and accordingly no relative difference is noticed. That is, since the accelerator pedal angles are proper, AP1 is always adopted as the accelerator pedal angle AP, the procedure proceeding to the next step 56.

At Step 56, whether or not "1" is set at the second relative abnormality flag $F_{NGAP2}$ is determined. Since "1" is not present at first, the procedure proceeds to Step 57, where "0" is entered to the first relative abnormality flag $F_{NGAP1}$, and then, at Step 58, the up-timer $T_{NG}$ is reset.

When $F_{NGAP2}=1$, the procedure jumps from Step 56 to Step 58.

When a relative abnormality is noticed due to a great difference between AP1 and AP2, the procedure proceeds to Step 51, where it is determined whether or not the up-timer $T_{NG}$ exceeds the specific time $T_2$. If the uptime remains within the specific time $T_2$, it is determined at Step 52 whether or not "1" stands at the first relative abnormal flag $F_{NGAP1}$. Under the initial condition that "1" is not set up, "1" is set up at the first relative abnormality flag $F_{NGAP1}$ at Step 52 and the uptimer $T_{NG}$ is reset at Step 54.

At Step 52, when "1" already stands at the first relative abnormality flag $F_{NGAP1}$, the procedure jumps to Step 55, where "1" is set up at the second relative abnormality flag $F_{NGAP2}$.

That is, when the relative abnormality continues for the specific time $T_2$ first "1" stands at the first relative abnormality flag $F_{NGAP1}$ at Step 53, and furthermore the relative abnormality continues for the specific time $T_2$, "1" is first set up at the second relative abnormality flag $F_{NGAP2}$ at Step 55. The second relative flag $F_{NGAP2}$ will finally become a flag indicating a relative abnormality of No. 1 accelerator pedal angle sensor 3 and No. 2 accelerator pedal angle sensor 4.

The check routine of the accelerator pedal angle sensors has now been finished; if, at this stage, any abnormality is noticed in the first accelerator pedal angle sensor 3, "1" will be set up at the AP1 abnormality flag $F_{AP12}$. When any abnormality is noticed in the second accelerator pedal angle sensor 4, "1" will be set up at the AP2 abnormality flag $F_{AP22}$. Further when a relative abnormality is noticed in first and second accelerator pedal angle sensors 3 and 4, "1" will be set at the relative abnormality flag $F_{NGAP2}$.

Figure 3:
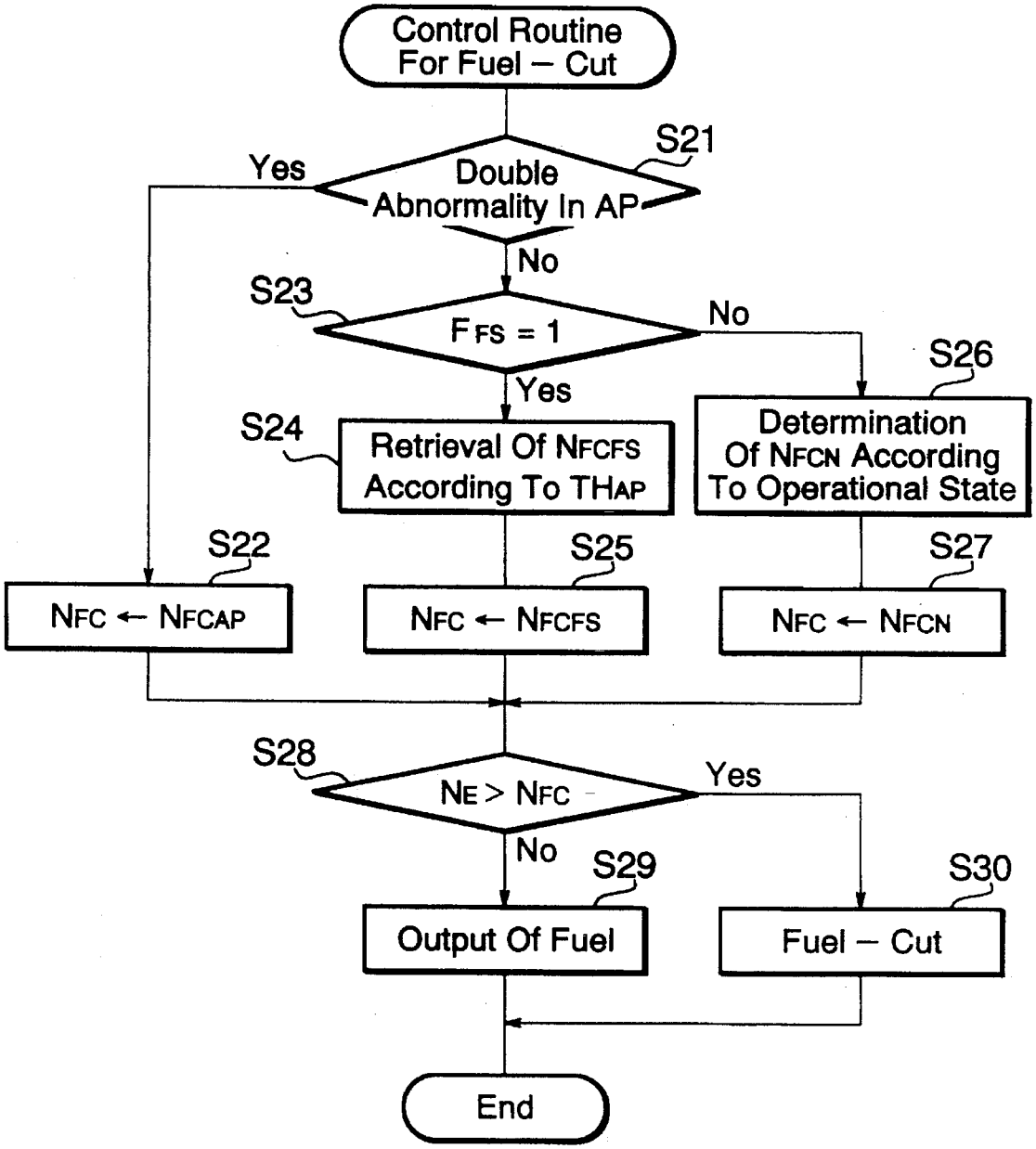
FIG. 3 is a flowchart showing a fuel cut-off control routine of FI-CPU.

If "1" is set at one of flags of the throttle control system such as the accelerator pedal angle sensor abnormality flags $F_{AP12}$ and $F_{AP22}$ and the relative abnormality flag $F_{NGAP2}$ in the accelerator pedal check routine, "1" will stand at the fail-safe flag $F_{FS}$, and a specific low upper limit value $TH_{HS}$ is provided to restrict the throttle opening (Steps 13 and 14 in FIG. 2), and also a table look-up is executed of the engine speed $N_{FCFS}$ corresponding to the throttle opening $TH_{AP}$ based on the normal accelerator pedal angle at Step 24 in FIG. 3 to set a fuel cut-off threshold value $N_{FC}$ at Step 25. When the engine speed $N_E$ has exceeded this fuel cut-off threshold value, the fuel supply is shut off at Step 30. When the engine speed $N_E$ has not exceeded the fuel cut-off threshold value, the fuel supply continues (Step 29); and therefore if a relative abnormality is noticed in first and second accelerator pedal angle sensors 3 and 4, it is possible to prevent a sudden increase in the engine output.

In the present invention, since the smaller one of the outputs of first and second accelerator pedal angle sensors is adopted, it is possible to prevent the effect of noise and also to constantly continue the operation of the internal-combustion engine.

When a difference in outputs between first and second accelerator pedal angle sensors is within a permissible range, the NORMAL selection means selects the output of the first accelerator pedal angle sensor, thus deciding normal to allow the detection of abnormality throughout the range of the accelerator pedal angle.

When the specific length of time has elapsed after the NORMAL selection means stopped selection, an upper limit is set for the target value by the upper-limit value setting means, thereby enabling the continuance of a certain degree of vehicle operation even if there occurs an abnormality in the accelerator pedal angle sensors.

What is claimed is:

1. A control device for controlling an intake air quantity and a fuel amount for an internal combustion engine comprising:

a first accelerator pedal angle sensor for detecting a first accelerator pedal angle and generating a first output signal representative thereof;

a second accelerator pedal angle sensor for detecting a second accelerator pedal angle and generating a second output signal representative thereof;

a microprocessor controller for controlling said intake air quantity provided to said internal combustion engine by controlling an actuator which drives said throttle valve and for controlling said fuel amount, said microprocessor controller functioning to (a) generate a target value for said actuator according to an accelerator pedal angle;

(b) selecting, as said accelerator pedal angle, a lower value of one of said first and second accelerator pedal angle output signals;

(c) driving said throttle valve to said target value in accordance with said lower value of said first and second pedal angle output signals to minimize potentiometer noise due to aging degradation;

(d) control a gating circuit for actuating fuel injectors and ignition circuits;

(e) generate injection signals for the gating circuit operation as a function of preselected engine parameters;

(f) generate ignition signals for the gating circuit as a function of preselected engine parameters and (g) drive said gating circuit with appropriately determined said injection and ignition signals to actuate said injectors and ignition circuit.

2. A control device for an internal combustion engine as claimed in claim 1, wherein said microprocessor controller further performing the functions of setting a permissible range of a difference between said first and second pedal angle outputs; and selecting said first pedal angle output as said accelerator pedal angle when the difference between said first and second pedal angle outputs is within a permissible range.

3. A control device for an internal combustion engine as claimed in claim 2, wherein said microprocessor controller further performing the functions of measuring time that has elapsed after an end of selection of said first accelerator pedal angle sensor; and setting an upper-limit value at a target value set when a decision is made of a lapse of a specific time after completion of selection of said first pedal angle output.

* * * * *